US006253055B1

(12) United States Patent
Badesha et al.

(10) Patent No.: US 6,253,055 B1
(45) Date of Patent: Jun. 26, 2001

(54) FUSER MEMBER COATED WITH HYDRIDE RELEASE OIL, METHODS AND IMAGING APPARATUS THEREOF

(75) Inventors: Santokh S. Badesha, Pittsford; David H. Pan, Rochester; Samuel Kaplan, Walworth; Clifford O. Eddy, Webster; Arnold W. Henry, Pittsford; George J. Heeks, Rochester; Che C. Chow, Penfield; Louis D. Fratangelo, Fairport; David J. J. Fraser, Webster; Edward C. Hanzlik, Fairport, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 08/744,031

(22) Filed: Nov. 5, 1996

(51) Int. Cl.[7] ..... G03G 15/20
(52) U.S. Cl. ..... 399/324; 399/320; 430/99
(58) Field of Search ..... 399/320, 324, 399/325, 328; 430/120, 99; 524/714

(56) References Cited

U.S. PATENT DOCUMENTS

| | | | | |
|---|---|---|---|---|
| 4,029,827 | * | 6/1977 | Imperial et al. | 430/120 X |
| 4,132,882 | | 1/1979 | Ichiro et al. | 219/216 |
| 4,257,699 | | 3/1981 | Lentz | 355/3 FU |
| 4,264,181 | | 4/1981 | Lentz et al. | 355/3 FU |
| 4,272,179 | | 6/1981 | Seanor | 355/3 FU |
| 4,515,884 | | 5/1985 | Field et al. | 430/99 |
| 4,659,621 | | 4/1987 | Finn et al. | 428/339 |
| 4,711,818 | | 12/1987 | Henry | 428/421 |
| 4,777,087 | * | 10/1988 | Heeks et al. | 524/714 X |
| 4,925,895 | * | 5/1990 | Heeks et al. | 524/714 |
| 5,017,432 | | 5/1991 | Eddy et al. | 428/422 |
| 5,061,965 | | 10/1991 | Ferguson et al. | 355/284 |
| 5,401,570 | | 3/1995 | Heeks et al. | 428/332 |
| 5,501,881 | * | 3/1996 | Fuller et al. | 430/99 X |
| 5,512,409 | | 4/1996 | Henry et al. | 430/24 |
| 5,516,361 | | 5/1996 | Chow et al. | 106/2 |

* cited by examiner

*Primary Examiner*—Fred L. Braun
(74) *Attorney, Agent, or Firm*—Annette L. Bade

(57) ABSTRACT

A fuser member having a fuser member release agent for use in an electrophotographic apparatus for enhancing toner release from a fuser member, the fuser member having a substrate, an outer fluoropolymer layer optionally having a conductive filler, and a silicone hydride release oil component thereover and methods and imaging apparatus thereof, are set forth.

32 Claims, 2 Drawing Sheets

FUSER MEMBER COATED WITH HYDRIDE RELEASE OIL, METHODS AND IMAGING APPARATUS THEREOF

BACKGROUND OF THE INVENTION

The present invention relates to fusing members and, more specifically, the present invention relates to fuser member coatings comprising functional release agents that, for example, enhance release of toner from a fuser roll in an electrostatographic, especially xerographic, machine. In embodiments, the release agents of the present invention are comprised of a hydride (SiH) functional silicone oil that prevents offset by providing a coating on a fuser roll substrate, which preferably has an outer layer of a high temperature resistant polymer and in embodiments, a fluoropolymer. In embodiments, the coating reacts with a conductive filler which is present on the polymer surface layer of the fuser roll. Advantages of the fuser members of the present invention include, in embodiments, reduction in toner offset, providing lower surface energy of the outer fusing layers, providing a more uniform coating of fusing oil on the fusing surface layer, decreasing the amount of wax needed in toners, increasing fuser release life, and rapid diffusion of the fuser oil into the copy sheet, thereby reducing or alleviating the problems of poor fix of certain inks such as magnetic inks and reducing or eliminating poor adhesion of binding glues and attachable notes such as 3-M Post-It® notes. In embodiments, the release coatings of the present invention can be obtained by combining a hydride functional siloxane with active functional groups on filler components thereby providing a low surface energy silicone surface over the filler. The fuser members of the present invention including the fuser oils herein, which can be selected for a number of known electrophotographic imaging and printing processes, possess a number of advantages as indicated herein.

In a typical electrostatographic reproducing apparatus, a light image of an original to be copied is recorded in the form of an electrostatic latent image upon a photosensitive member, and the latent image is subsequently rendered visible by the application of electroscopic thermoplastic resin particles and pigment particles, or toner. The visible toner image is then in a loose powdered form and can be easily disturbed or destroyed. The toner image is usually fixed or fused upon a support which may be the photosensitive member itself or other support sheet such as plain paper.

The use of thermal energy for fixing toner images onto a support member is well known. To fuse electroscopic toner material onto a support surface permanently by heat, it is usually necessary to elevate the temperature of the toner material to a point at which the constituents of the toner material coalesce and become tacky. This heating causes the toner to flow to some extent into the fibers or pores of the support member. Thereafter, as the toner material cools, solidification of the toner material causes the toner material to be firmly bonded to the support.

Typically, the thermoplastic resin particles are fused to the substrate by heating to a temperature of between about 90° C. to about 200° C. or higher depending upon the softening range of the particular resin used in the toner. It may be undesirable, however, to increase the temperature of the substrate substantially higher than about 250° C. because of the tendency of the substrate to discolor or convert into fire at such elevated temperatures, particularly when the substrate is paper.

Several approaches to thermal fusing of electroscopic toner images have been described. These methods include providing the application of heat and pressure substantially concurrently by various means, a roll pair maintained in pressure contact, a belt member in pressure contact with a roll, a belt member in pressure contact with a heater, and the like. Heat may be applied by heating one or both of the rolls, plate members, or belt members. The fusing of the toner particles takes place when the proper combination of heat, pressure and contact time are provided. The balancing of these parameters to bring about the fusing of the toner particles is well known in the art, and can be adjusted to suit particular machines or process conditions.

During operation of a fusing system in which heat is applied to cause thermal fusing of the toner particles onto a support, both the toner image and the support are passed through a nip formed between the roll pair, or plate or belt members. The concurrent transfer of heat and the application of pressure in the nip affects the fusing of the toner image onto the support. It is important in the fusing process that no offset of the toner particles from the support to the fuser member take place during normal operations. Toner particles offset onto the fuser member may subsequently transfer to other parts of the machine or onto the support in subsequent copying cycles, thus increasing the background or interfering with the material being copied there. The referred to "hot offset" occurs when the temperature of the toner is increased to a point where the toner particles liquefy and a splitting of the molten toner takes place during the fusing operation with a portion remaining on the fuser member. The hot offset temperature or degradation of the hot offset temperature is a measure of the release property of the fuser roll, and accordingly it is desired to provide a fusing surface which has a low surface energy to provide the necessary release. To ensure and maintain good release properties of the fuser roll, it has become customary to apply release agents to the fuser roll during the fusing operation. Typically, these materials are applied as thin films of, for example, silicone oils or amino oils, to prevent toner offset.

U.S. Pat. No. 4,257,699 to Lentz, the subject matter of which is hereby incorporated by reference in its entirety, discloses a fuser member comprising at least one outer layer of an elastomer containing a metal-containing filler and use of a polymeric release agent.

U.S. Pat. No. 4,264,181 to Lentz et al., the subject matter of which is hereby incorporated by reference in its entirety, discloses a fuser member having an elastomer surface layer containing a metal-containing filler therein and use of a polymeric release agent.

U.S. Pat. No. 4,272,179 to Seanor, the subject matter of which is hereby incorporated by reference in its entirety, discloses a fuser member having an elastomer surface with a metal-containing filler therein and use of a mercapto-functional polyorganosiloxane release agent.

U.S. Pat. No. 5,401,570 to Heeks et al., the subject matter of which is hereby incorporated by reference in its entirety, discloses a fuser member comprised of a substrate and thereover a silicone rubber surface layer containing a filler component, wherein the filler component is reacted with a silicone hydride release oil.

U.S. Pat. No. 4,515,884 to Field et al., the subject matter of which is hereby incorporated by reference in its entirety, discloses a fuser member having a silicone elastomer fusing surface which is coated with a toner release agent which includes an unblended polydimethyl siloxane.

U.S. Pat. No. 5,512,409 to Henry et al. teaches a method of fusing thermoplastic resin toner images to a substrate using amino functional silicone oil over a hydrofluoroelastomer fuser member.

U.S. Pat. No. 5,516,361 to Chow et al. teaches a fusing member having a thermally stable FKM hydrofluoroelastomer surface and having a polyorgano T-type amino functional oil release agent. The oil has predominantly monoamino functionality per active molecule to interact with the hydrofluoroelastomer surface.

The use of polymeric release agents having functional groups, which interact with a fuser member to form a thermally stable, renewable self-cleaning layer having good release properties for electroscopic thermoplastic resin toners, is described in U.S. Pat. Nos. 4,029,827; 4,101,686; and 4,185,140, the disclosures each of which are incorporated by reference herein in their entirety. Disclosed in U.S. Pat. No. 4,029,827 is the use of polyorganosiloxanes having mercapto functionality as release agents. U.S. Pat. Nos. 4,101,686 and 4,185,140 are directed to polymeric release agents having functional groups such as carboxy, hydroxy, epoxy, amino, isocyanate, thioether and mercapto groups as release fluids.

The preferred release agents for fuser members are silicone release oils and monoamino silicone release oils. However, depending on the type of outer layer of the fuser member chosen, there may be several drawbacks to using silicone or monoamino silicone oils as release agents.

With regard to known fuser coatings, silicone rubber has been the preferred outer layer for fuser members in electrostatographic machines. Silicone rubbers interact well with various types of fuser release agents. However, polyfluoroalkoxypolytetrafluoroethylene (PFA Teflon) used as an outer coating for fuser members is more durable and abrasion resistant than silicone rubber coatings. Also, the surface energy for PFA Teflon is lower than silicone rubber coatings.

With regard to known fusing oils, silicone oil has been the preferred release agent for PFA Teflon coatings for fuser members. However, release agents comprising silicone oil do not provide sufficient release properties for toner because the silicone oil does not wet fuser coatings of PFA Teflon. Therefore, a large amount (greater than 5 mg/copy) of silicone oil is required to obtain minimum release performance. Alternatively, a large amount of wax must be incorporated into the toner in order to provide adequate release of the toner from the fuser member.

For other fluoropolymer, and especially fluoroelastomer fuser member outer layers, monoamino silicone oil has been the release agent of choice. However, monoamino oil does not diffuse into paper products, but instead, reacts with the cellulose in the paper and therefore remains on the surface of the paper. It is believed that hydrogen bonding occurs between the amine groups in the monoamino oil and the cellulose hydroxy groups of the paper. Alternatively, the amine groups may hydrolyze the cellulose rings in the paper. The monoamino oil on the surface of the copied paper prevents the binding of glues and adhesives, including the attachable notes such as adhesive of 3-M Post-it® notes, to the surface of the copied paper. In addition, the monoamino silicone oil present on the surface of a copied paper prevents ink adhesion to the surface of the paper. This problem results in the poor fix of inks such as bank check endorser inks, and other similar inks.

Yet another drawback to use of monoamino silicone and silicone fuser release agents is that the release agents do not always react as well with conductive fillers which may be present in the fuser roll surface. It is desirable for the release agent to react with the fillers present on the outer surface of the fuser member in order to lower the surface area of the fillers. The result is that the conductive filler may be highly exposed on the surface of the fuser member, thereby resulting in increased surface energy of the exposed conductive filler which will cause toner to adhere to it. An increased surface energy, in turn, results in decrease in release, increase in toner offset, and shorter fusing release life.

Therefore, there exists a specific need for a fusing member release agent for use with a polymer, and more specifically a fluoropolymer, outer layer of a fuser member, wherein the release agent does not remain on the surface of the copy sheet. In addition, a specific need exists for a release agent useful in connection with conductive particle filled fluoropolymer outer surfaces of fuser members, wherein the release agent sufficiently reacts with the conductive filler on the outer surface of the fuser member, enabling a reduction in surface energy of the exposed conductive filler, which ultimately results in a decrease in toner offset and longer fuser release life. Moreover, a need exists for a fusing member release agent for use with a polymer outer layer of a fuser member, wherein the release agent which can be used in relatively small amounts and wherein the release agent does not require a relatively large amount of wax to be incorporated into the toner in order to be effective.

SUMMARY OF THE INVENTION

Examples of objects of the present invention include:

It is an object of the present invention to provide fuser member coatings comprising fusing member release agents and methods thereof with many of the advantages indicated herein.

Another object of the present invention is to provide fuser member release agents which do not remain on the surface of the copy sheet.

Yet another object of the present invention is to provide fuser member release agents which chemically react with conductive fillers on the surface of the fuser member in order to reduce the surface energy of the exposed conductive fillers.

Still yet another object of the present invention is to provide fuser member release agents which allow for an increase in the ability to fix inks to the copy sheet.

Still a further object of the present invention is to provide fuser member release agents which increase the ability for adhesion of glues and adhesives to the surface of the copy sheet.

It is further an object of the present invention to provide fuser member release agents which wherein relatively small amounts are necessary for effectiveness.

It is yet another object of the present invention to provide fuser member release agents which do not require a relatively large amount of wax in the toner in order to be effective.

Another object of the present invention is to provide fuser member release agents which maintain excellent release properties thereby decreasing the occurrence of toner offset.

These and other objects have been met by the present invention which includes, in embodiments: a fuser member comprising: a) a substrate; b) an outer layer on the substrate, the outer layer comprising a polymer and thereover c) a hydride release component comprising a silicone hydride release oil.

These and other objects have further been met by the present invention which includes, in embodiments: a fuser member comprising: a) a substrate; b) an outer layer provided on the substrate, the outer layer comprising polyfluoroalkoxypolytetrafluoroethylene and containing an inorganic particulate filler selected from the group consisting of aluminum oxide and cupric oxide, wherein the filler is present on the surface of the outer layer; and c) a hydride release film present on the outer layer, the hydride release film comprising a poly(methylhydrosiloxane), and wherein the hydride release film reacts with the surface filler particles so as to lower the surface energy of the filler particles.

Moreover, these and other embodiments have been met by the present invention which includes, in embodiments: a fuser member comprising: a) a substrate; b) an outer layer provided on the substrate, the outer layer comprising a fluoroelastomer selected from the group consisting of i) copolymers of vinylidenefluoride and hexafluoropropylene; ii) terpolymers of vinylidenefluoride, hexafluoropropylene and tetrafluoroethylene; and iii) tetrapolymers of vinylidenefluoride, hexafluoropropylene, tetrafluoroethylene and a cure site monomer, wherein the outer layer contains a calcined alumina particulate filler dispersed therein and present on the surface of the fluoroelastomer outer layer; and c) a hydride release film present on the outer fluoroelastomer layer, the hydride release film comprising a poly(methylhydrosiloxane), and wherein the hydride release film reacts with the surface filler particles so as to lower the surface energy of the filler particles.

Other embodiments include: an image forming apparatus for forming images on a recording medium comprising: a) a charge-retentive surface to receive an electrostatic latent image thereon; b) a development component to apply toner to the charge-retentive surface to develop the electrostatic latent image to form a developed image on the charge retentive surface; c) a transfer component to transfer the developed image from the charge retentive surface to a copy substrate; and d) a fixing component for fusing toner images to a surface of the copy substrate, wherein the fixing component comprises a fuser member comprising: i) a substrate; ii) an outer layer provided on the substrate, the outer layer comprising a polymer; and iii) a hydride release film over the outer surface of the outer polymer layer, the hydride release film comprising a silicone hydride release oil.

Other embodiments of the present invention include: an electrophotographic process comprising: a) forming an electrostatic latent image on charge-retentive surface; b) applying toner to the latent image to form a developed image on the charge retentive surface; c) transferring the toner image from the charge-retentive surface to a copy substrate; d) fixing the toner image to the copy substrate by passing the copy substrate containing the toner image in between a pressure member and a fixing member, wherein the pressure member and the fixing member are in pressure contact, and the fixing member comprises: i) a substrate; ii) an outer layer provided on said substrate, said outer layer comprising a polymer; and iii) a hydride release film over said outer surface of said outer polymer layer, said hydride release film comprising a silicone hydride release oil.

The fuser member release agents provided herein, the embodiments of which are further described herein, allow for a decrease in the amount of fuser oil necessary for toner release, enable reduction in surface energy of the conductive fillers present on the surface of the fuser member while allowing for sufficient fix of inks, adhesives and glues to the surface of copy sheets.

BRIEF DESCRIPTION OF THE DRAWINGS

For a better understanding of the present invention, reference may be had to the accompanying Figure.

DETAILED DESCRIPTION OF THE PRESENT INVENTION

The present invention is directed to fuser members for use in electrostatographic machines, and more specifically, fuser members comprising a support, and having thereon an outer layer. In embodiments, the outer layer comprises a polymer such as a fluoropolymer and, in particular embodiments, further contains an inorganic particulate filler. In specific embodiments, the fuser members herein comprise a silicone hydride release agent film over the outer polymer surface layer of the fuser member. Also in embodiments, the release agent reacts with the filler present on the outer surface of the fuser member in order to reduce the surface energy of the exposed conductive particulate fillers and increase toner release.

Figure 1:
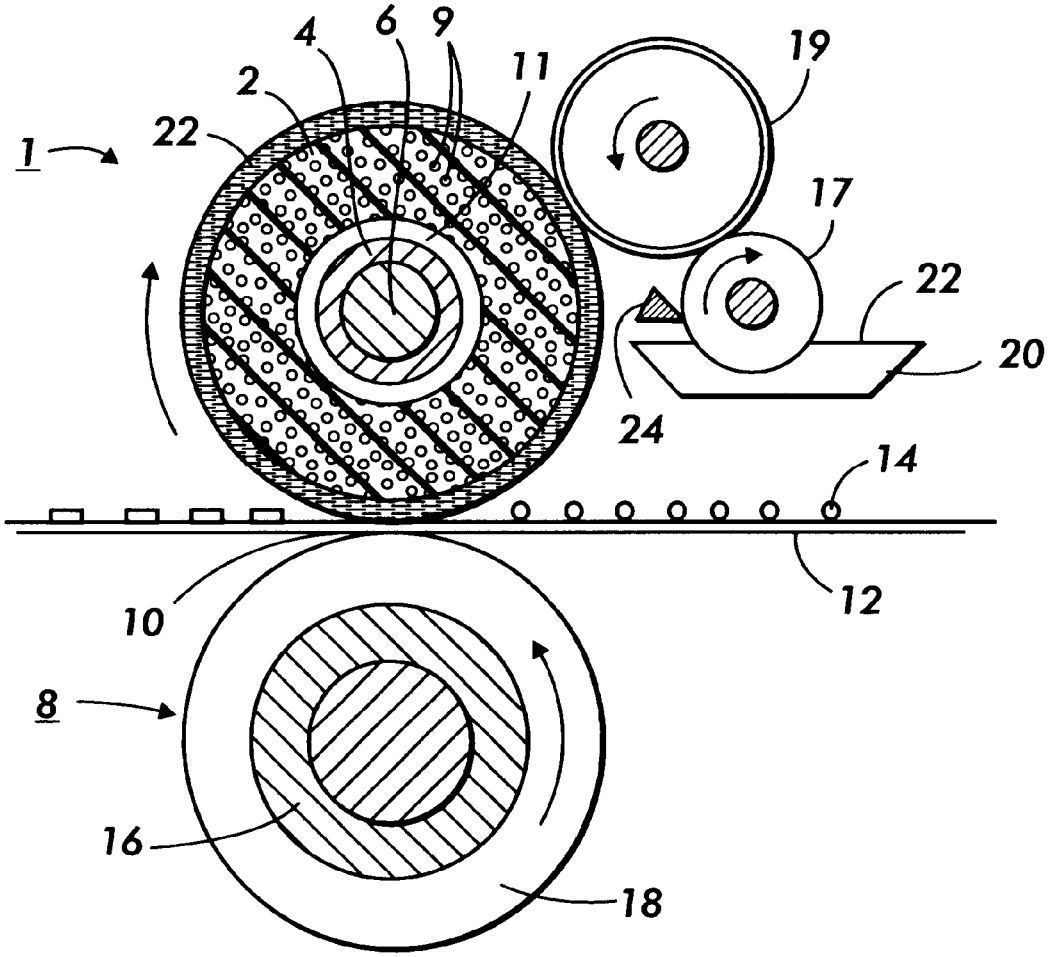
FIG. 1 illustrates a fusing system in accordance with an embodiment of the present invention.

The present process, in embodiments, enables surfaces as described in conjunction with a fuser assembly as shown in FIG. 1 where the numeral 1 designates a fuser roll comprising elastomer surface 2 upon a suitable base member 4, a hollow cylinder or core fabricated from any suitable metal, such as aluminum, anodized aluminum, steel, nickel, copper, and the like, having a suitable heating element 6 disposed in the hollow portion thereof which is coextensive with the cylinder. Backup or pressure roll 8 cooperates with fuser roll 1 to form a nip or contact arc 10 through which a copy paper or other substrate 12 passes such that toner images 14 thereon contact elastomer surface 2 of fuser roll 1. As shown in FIG. 1, the backup roll 8 has a rigid steel core 16 with a polymer or elastomer surface or layer 18 thereon. Sump 20 contains polymeric release agent 22 which may be a solid or liquid at room temperature, but it is a fluid at operating temperatures.

In the embodiment shown in FIG. 1 for applying the polymeric release agent 22 to polymer or elastomer surface 2, two release agent delivery rolls 17 and 19 rotatably mounted in the direction indicated are provided to transport release agent 22 to polymer or elastomer surface 2. Delivery roll 17 is partly immersed in the sump 20 and transports on its surface release agent from the sump to the delivery roll 19. By using a metering blade 24, a layer of polymeric release fluid can be applied initially to delivery roll 19 and subsequently to polymer or elastomer 2 in controlled thickness ranging from submicrometer thickness to thickness of several micrometers of release fluid. Thus, by metering device 24, about 0.1 to 2 micrometers or greater thicknesses of release fluid can be applied to the surface of elastomer 2.

Figure 2:
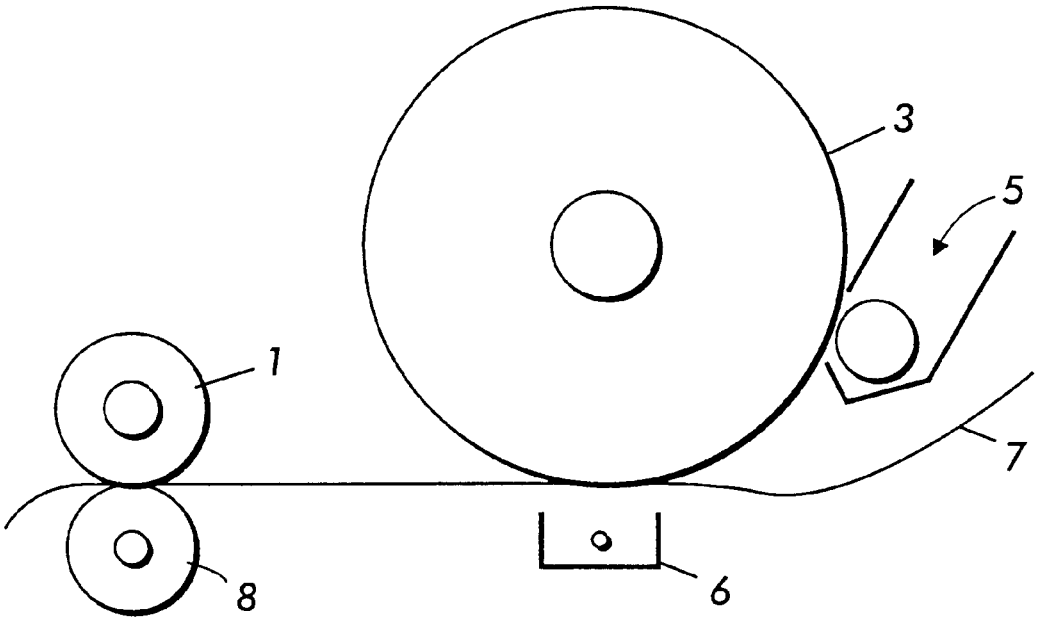
FIG. 2 illustrates an image forming apparatus in which the fusing system of the present invention is used.

An image forming apparatus for forming images on a recording medium is also set forth and depicted in FIG. 2. The image forming apparatus comprises: a) a charge-retentive surface 3 to receive an electrostatic latent image thereon; b) a development component 5 to apply toner to said charge-retentive surface to develop said electrostatic latent image to form a developed image on said charge retentive surface; c) a transfer component 6 to transfer the developed image from said charge retentive surface to a copy substrate; and d) a fixing component 1 for fusing toner images to a surface of said copy substrate. A pressure member 8 is also set forth.

In accordance with the present invention, the substrate for fixing or fusing a thermoplastic resin powder image to a substrate at elevated temperatures may be either a hollow or solid roll, a flat surface, a belt or of any other suitable configuration. However, in accordance with a preferred embodiment of the present invention, the substrate is in the form of a hollow cylindrical roll.

The types of components such as rolls that can be provided with the coatings of the present invention are illustrated, for example, in U.S. Pat. Nos. 4,373,239 and 4,518,655, the disclosures each of which are totally incorporated herein by reference. The substrate can be constructed entirely of the polymer. However, in preferred embodiments, the substrate is a roll structure comprising a base member made of a hollow cylindrical metal core such as copper, aluminum, steel and the like or coated layers of copper, steel, and aluminum and the like, having a working surface of polymer which, in embodiments, contains an inorganic particulate filler dispersed therein and present on the surface of the polymer. The base member may be any suitable material having a polymer layer adhered thereto, and the design is not limited to any particular metal, nonmetal or composite.

The outer or top surface of the fuser member, or the entire composition of the fuser member, in embodiments, is comprised of a polymer, preferably a fluoropolymer. The fluoropolymer must be a heat stable elastomer or resin material which can withstand elevated temperatures generally from about 90° C. up to about 200° C. or higher depending upon the temperature desired for fusing or fixing the thermoplastic resin powder to the substrate. The fluoropolymer used in the present invention must react with but not be degraded by the hydride release agents which are used to promote release of the molten or tacktified thermoplastic resin powder or toner from the fuser member surface.

Examples of the outer surface or intermediate layer of the fuser system members in the present invention include polymers such as fluoropolymers. Specifically, suitable fluoropolymers are those described in detail in U.S. Pat. Nos. 5,166,031, 5,281,506, 5,366,772 and 5,370,931, together with U.S. Pat. Nos. 4,257,699, 5,017,432 and 5,061,965, the disclosures each of which are incorporated by reference herein in their entirety. As described therein these fluoropolymers, particularly from the class of copolymers of vinylidenefluoride and hexafluoropropylene; terpolymers of vinylidenefluoride, hexafluoropropylene and tetrafluoroethylene; and tetrapolymers of vinylidenefluoride, hexafluoropropylene, tetrafluoroethylene and cure site monomer, are known commercially under various designations as VITON A®, VITON E®, VITON E 60C®, VITON E430®, VITON 910®, VITON GH® and VITON GF®. The VITON® designation is a Trademark of E.I. DuPont de Nemours, Inc. The cure site monomer can be 4-bromoperfluorobutene-1,1,1-dihydro-4-bromoperfluorobutene-1,3-bromoperfluoropropene-1,1,1-dihydro-3-bromoperfluoropropene-1, or any other suitable, known cure site monomer commercially available from DuPont. Other commercially available fluoropolymers include FLUOREL 2170®, FLUOREL 2174®, FLUOREL 2176®, FLUOREL 2177® and FLUOREL LVS 76®, FLUOREL® being a Trademark of 3M Company. Additional commercially available materials include AFLAS™ a poly(propylene-tetrafluoroethylene) and FLUOREL II® (LII900) a poly(propylene-tetrafluoroethylenevinylidenefluoride) both also available from 3M Company, as well as the Tecnoflons identified as FOR-60KIR®, FOR-LHF®, NM® FOR-THF®, FOR-TFS®, TH®, and TN505®, available from Montedison Specialty Chemical Company.

Other fluoropolymers useful in the present invention include polytetrafluoroethylene (PTFE), fluorinated ethylenepropylene copolymer (FEP), polyfluoroalkoxypolytetrafluoroethylene (PFA Teflon) and the like.

These fluoropolymers, together with adhesives, can also be included as intermediate layers.

Preferred fluoropolymers useful for the surface of fuser members in the present invention include fluoroelastomers, such as fluoroelastomers of vinylidenefluoride based fluoroelastomers, which contain hexafluoropropylene and tetrafluoroethylene as comonomers. Three preferred known fluoroelastomers are (1) a class of copolymers of vinylidenefluoride and hexafluoropropylene known commercially as VITON A® (2) a class of terpolymers of vinylidenefluoride, hexafluoropropylene and tetrafluoroethylene known commercially as VITON B® and (3) a class of tetrapolymers of vinylidenefluoride, hexafluoropropylene, tetrafluoroethylene and cure site monomer known commercially as VITON GH® or VITON GF®. VITON A®, VITON B®, VITON GH®, VITON GF® and other VITON® designations are trademarks of E.I. DuPont de Nemours and Company.

The fluoroelastomers VITON GH® and VITON GF® available from E.I. DuPont de Nemours Inc., have a preferred embodiment of relatively low amounts of vinylidenefluoride. The VITON GF® and Viton GH® have 35 weight percent of vinylidenefluoride, 34 weight percent of hexafluoropropylene and 29 weight percent of tetrafluoroethylene with 2 weight percent cure site monomer.

In a further preferred embodiment, the fluoropolymer is PFA Teflon, FEP, PTFE, VITON GF® or VITON GH®. In a particularly preferred embodiment, the fluoropolymer is PFA Teflon, VITON GF® or VITON GH®.

The amount of fluoropolymer compound in solution in weight percent total solids is from about 10 to about 25 percent preferably from about 16 to about 22 percent by weight of total solids. Total solids as used herein includes the amount of fluoropolymer, dehydrofluorinating agent and optional adjuvants and fillers, including metal oxide fillers.

Any known solvent suitable for dissolving a fluoropolymer in the preparation of the fluoropolymer surface may be used. Examples of suitable solvents for the present invention include methyl ethyl ketone, methyl isobutyl ketone, diethyl ketone, n-butyl acetate, amyl acetate, and the like. Specifically, the solvent is added in an amount of from about 75 to about 90 weight percent, preferably from about 78 to about 84 weight percent based on the weight of total solids.

The dehydrofluorinating agent which attacks the hydrofluoroelastomer class of fluoropolymers generating unsaturation is selected from basic metal oxides such as MgO, CaO, $Ca(OH)_2$ and the like, and strong nucleophilic agents such as primary, secondary and tertiary, aliphatic and aromatic amines, where the aliphatic and aromatic amines have from about 2 to about 15 carbon atoms. Also included are aliphatic and aromatic diamines and triamines having from about 2 to about 15 carbon atoms where the aromatic groups may be benzene, toluene, naphthalene, anthracene, and the like. It is generally preferred for the aromatic diamines and triamines that the aromatic group be substituted in the ortho, meta and para positions. Typical substituents include lower alkyl amino groups such as ethylamino, propylamino and butylamino, with propylamino being preferred. The particularly preferred curing agents are the nucleophilic curing agents such as VITON CURATIVE VC-50® which incorporates an accelerator (such as a quaternary phosphonium salt or salts like VC-20) and a crosslinking agent (bisphenol AF or VC-30); DIAK 1 (hexamethylenediamine carbamate) and DIAK 3 (N,N'-dicinnamylidene-1,6 hexanediamine). VC-50 is preferred due to the more thermally stable product it provides. The dehydrofluorinating agent is added in an amount of from about 1 to about 20 parts per hundred of hydrofluoroelastomer, and preferably from about 4 to about 6 parts per hundred of hydrofluoroelastomer.

An inorganic particulate filler (9 in FIG. 1) may be and is usually used in connection with the fluoropolymer outer layer. The inorganic particulate filler, in embodiments, increases the abrasion resistance of the outer layer. The inorganic particulate filler may be dispersed in the fluoropolymer in any suitable manner, but in preferred embodiments, the inorganic particulate filler is uniformly dispersed throughout the fluoropolymer layer, coating or body, and in a particularly preferred embodiment, is also present on the surface of the fluoropolymer outer layer. In a preferred embodiment, the inorganic particulate filler is dispersed or disposed in the proximal working surface of the fuser member as desired to provide the filler at or near the surface for interaction with the functional release agent. Preferred fillers include a metal-containing filler, such as a metal, metal alloy, metal oxide, metal salt or other metal compound. The general classes of metals which are applicable to the present invention include those metals of Groups 1*b*, 2*a*, 2*b*, 3*a*, 3*b*, 4*a*, 4*b*, 5*a*, 5*b*, 6*b*, 7*b*, 8 and the rare earth elements of the Periodic Table. Preferably, the filler is an oxide of aluminum, copper, tin, zinc, lead, iron, platinum, gold, silver, antimony, bismuth, zinc, iridium, ruthenium, tungsten, manganese, cadmium, mercury, vanadium, chromium, magnesium, nickel and alloys thereof. The particularly preferred inorganic particulate fillers are aluminum oxide and cupric oxide. Preferred fillers also include reinforcing and non-reinforcing calcined alumina and tabular alumina respectively.

The inorganic particulate filler may be present in the polymer in an amount sufficient to interact with the hydride release agent having functional groups. This generally comprises an amount from about 15 to about 25 volume percent, preferably from about 19 to about 22 based upon the volume of the polymer in the outer layer of the fuser member.

The particle size of the filler dispersed in the polymer is from about 1 to about 9 micrometers, preferably from about 1 to about 3 micrometers.

The inorganic particulate filler may possess irregular shapes, however, any form of inorganic particulate may be used in the fusing surface like powders, platelets, spheroids, fibers, oval particles, and the like. The base support member may be selected from any suitable material.

Other adjuvants and fillers may be incorporated in the fluoropolymer outer layer in accordance with the present invention as long as they do not effect the integrity of the fluoropolymer or the interaction between the optional inorganic particulate filler material and the hydride release agent having functional groups. Such fillers normally encountered in the compounding of fluoropolymers include coloring agents, reinforcing fillers, cross-linking agents, processing aids and accelerators.

The outer layer of the fuser member is preferably prepared by mixing a solvent such as methyl ethyl ketone, methyl isobutyl ketone and the like with a fluoropolymer compound containing the desired type(s) and amount(s) of inorganic filler particles and curative agents along with steel shot for mixing. The mixture is stirred to allow the filler and optional additive(s) to become wet from the solvent (approximately 1 minute). Next, an amount of polymer, preferably a fluoropolymer, is added and the contents are mixed (approximately 20–40 minutes, and preferably 30 minutes). A curative and stabilizer (for example, methanol) are then added and mixed again (approximately 15 minutes). The final solid content of the dispersion is from about 10 to about 25 percent and preferably from about 16 to about 22 percent by weight. The steel shot is filtered, the dispersion collected and then coated onto the substrate. The coated layers are first air-dried (approximately 2–5 hours) and then step heat cured in a programmable oven (65° C. for 4 hours, 93° C. for 2 hours, 144° C. for 2 hours, 177° C. for 2 hours, 204° C. for 2 hours and 232° C. for 16 hours).

The outer surface is deposited on the substrate via well known processes including applying the fluoropolymer optionally containing the inorganic filler particles therein to the substrate either by one application or by successive applications of a thin coating or coatings of the outer layer. Coating is conveniently carried out by flow coating, dipping or spraying such as by multiple spray applications of very thin films, web deposition, powder coating or the like can also be used. If successive applications of coatings are used, it may be necessary to heat the fluoropolymer layer after each successive application in order to remove the solvent. The layer can be heated to from about 25 to about 50° C. or higher so as to flash off most of the solvent contained in the outer layer.

The thickness of the outer fluoropolymer surface layer of the fuser member herein is from about 25 to about 250 micrometers, preferably from about 50 to about 200 micrometers.

Optional intermediate adhesive layers and/or intermediate polymer or elastomer layers may be applied to achieve desired properties and performance objectives of the present invention. The intermediate layer (11 in FIG. 1) may be present between the substrate and the outer polymer surface. An adhesive intermediate layer may be selected from, for example, epoxy resins and polysiloxanes. Preferred adhesives are proprietary materials such as THIXON 403/404, Union Carbide A-1100, Dow TACTIX 740, Dow TACTIX 741, and Dow TACTIX 742. A particularly preferred curative for the aforementioned Dow TACTIX 741 and 742 adhesives is Dow H41. Intermediate polymer layers may be selected from the fluoropolymers listed above, as well as any suitable silicone rubbers.

There may be provided an adhesive layer between the substrate and the intermediate layer. There may also be an adhesive layer between the intermediate layer and the outer layer. In the absence of an intermediate layer, the polymer outer layer may be bonded to the substrate via an adhesive layer.

The thickness of the intermediate layer is from about 0.5 to about 20 mm, preferably from about 1 to about 5 mm.

The release agents or fusing oils described herein are provided onto the outer layer of the fuser member via a delivery mechanism such as a delivery roll. The delivery roll is partially immersed in a sump which houses the fuser oil or release agent. The hydride release agent or hydride oil is renewable in that the release oil is housed in a holding sump and provided to the fuser roll when needed, optionally by way of a release agent donor roll in an amount of from about 0.0.1 to about 10 mg/copy, and preferably from about 1 to about 8 mg/copy, or in an amount of from about 0.1 to about 4 micrometers thick, preferably from about 0.1 to about 2.5 micrometers. The system by which fuser oil is provided to the fuser roll via a holding sump and optional donor roll is well known. The release oil (22 FIG. 1) may be present on the fuser member in a continuous or semicontinuous phase. The fuser oil in the form of a film is in a continuos phase and continuously covers the fuser member.

Any silicone hydride oil having functional groups that interact with the fillers on the outer surface of the fuser member so as to lower the surface energy thereof may be used. It is preferred that the silicone hydride oil function so as to absorb into the cellulose fibers of the paper, while retaining the functionality. Such a suitable functional silicone hydride oil may be used in combination with a non-functional release agent. Specific examples of functional silicone hydride oils selected for the present application include poly(methyl hydrosiloxanes) and in embodiments, poly(methyl hydrosiloxanes) with pendent or terminal hydride groups. Preferred examples include those having pendant hydride groups such as those from Hüls of America, for example, Hüls PS 123.8 a poly(methyl hydrosiloxane) having 0.75 weight % pendant hydride groups; and PS 124.5 [poly(methyl hydrosiloxane) having 3.5 weight % pendant hydride groups]; and the like. Examples of hydride terminated functional silicone oils available from Hüls of America are PS 542, a 500 cs polydimethylsiloxane oil with a terminal hydride group content of 0.8 weight percent; and PS 543, a 1000 cs polydimethylsiloxane oil with a terminal hydride group content of 0.5 weight percent. The hydride content of the silicone hydride release oil of the present invention is from about 0.1 to about 5.0 weight percent, and preferably from about 0.5 to about 3.5 weight percent. These hydride functional oils can be selected as supplied, or they can be diluted with nonfunctional release oils commercially available, such as nonfunctional polydimethylsiloxanes from 100 cs to 20,000 cs. Standard, nonfunctional silicone oils of various viscosities are available from the well known silicone material suppliers such as the DC200 fluids from Dow Corning Silicones of Midland, Mich.; the SF96 fluids from G.E. Silicones of Waterford, N.Y. and the SWS 101 fluids from Wacker Silicones of Adrian, Mich.

When the functional hydride silicone oil is used in combination with a non-functional silicone oil, the amount of functional hydride oil is from about 0.5 to about 99.5, and preferably from about 15 to about 85 weight percent of the non-functional silicone oil. The concentration of the aforementioned diluted non-functional oil is, for example, from about 0.5 to about 99.5, preferably from about 15 to about 85 weight percent of the functional hydride oil. One preferred composition of non-functional and functional oil is comprised of 15 weight percent of PS 124.5 and 85 weight percent of a nonfunctional oil. Molecular weights, gram/mole, and viscosity in centistokes, for the functional hydride oil can be, for example, from about 5,000 to about 30,000 and from about 100 to about 1,000 centistokes, respectively, while for the nonfunctional oils the corresponding values can be from about 5,000 to about 80,000, and from about 100 to about 20,000 centistokes, respectively.

A nonfunctional oil as used herein refers to oils which do not chemically react with the fillers on the surface of the fuser member. A functional oil as used herein refers to a release agent having functional groups which chemically react with the fillers present on the surface of the fuser member so as to reduce the surface energy of the fillers so as to provide better release of toner particles from the surface of the fuser member. If the surface energy of the fillers is not reduced, the toner particles will tend to adhere to the filler particles on the surface of the fuser oil, which will result in copy quality defects.

Catalysts may be used herein; however, it is not necessary to add catalysts in the present invention. Catalysts can be used for effective hydrosilation reaction. Examples of suitable catalysts include chloroplatinic acid or other complexes of the noble metals such as palladium, rhodium or ruthenium and the like. These catalysts are normally added on the basis of from about 5 to about 10 parts of platinum, palladium, rhodium or ruthenium per million of the hydride oil.

Although the mechanism of reaction of hydride functional oil with the polymer is not known, it is theorized that in embodiments, the hydride oil reacts with the hydroxy groups on the filler such as calcined alumina through hydrogen bonding and with the unsaturation sites on the polymer. The release agent has a higher affinity for the fillers on the surface of the fuser member than for the toner. The release coating has a cohesive force which is less than the adhesive forces between heated toner and the substrate to which it is applied and the cohesive forces of the toner. The release layer forms a barrier between the toner and the fuser member and helps to prevent toner from adhering to the surface of the fuser member. This results in a reduction in toner offset and an extension of the fuser release life. Also, in embodiments, the hydride functional oil is able to be absorbed into the copy sheet paper (cellulose fibers) and does not remain present on the surface of the copy sheet. In this manner, inks, glues and adhesives can readily attach to the copy sheet because there is minimal or no oil remaining on the surface of the copy sheet.

This plausible mechanism of reaction is in contrast to the mechanism of reaction by use of amino silicone oil. By use of amino silicone oil, the oil remains on the surface of the copy sheet, possibly by a hydrolysis reaction of the amino groups with the cellulose rings on the surface of the paper. The result is that inks, glues and adhesives cannot attach to the copy sheet due to the amino silicone oil remaining on the surface.

Therefore, the present invention includes fuser members comprising an outer polymer layer with optional fillers dispersed therein and present on the surface of the outer polymer layer, and further includes release agents provided thereover. The fuser members of the present invention allow for a decrease in the amount of fuser oil necessary for toner release and the amount of wax necessary for the toner, enable reduction in surface energy of the conductive fillers present on the surface of the fuser member while allowing for sufficient fix of inks, adhesives and glues to the surface of copy sheets.

All the patents and applications referred to herein are hereby specifically, and totally incorporated herein by reference in their entirety in the instant specification.

The following Examples further define and describe embodiments of the present invention. Unless otherwise indicated, all parts and percentages are by weight.

EXAMPLES

Example I

A poly(methyl hydrosiloxane) oil PS 124.5 obtained from Huls of America and containing 3.5 wt % hydride groups without added catalyst was used as the fuser oil release agent in a Xerox Corporation 4635MX copy machine. The fuser oil was added to the fuser oil sump and a layer of fuser oil coating of from about 1 to 8 mg/copy was applied to the fuser member. The fuser roll coating in the Xerox 4635MX copy machine was comprised of VITON GF filled with 20 volume percent calcined alumina which was prepared using known methods and more specifically, in accordance with the procedure outlined above.

One hundred preprinted bank personal checks were copied in the above Xerox 4635MX copy machine using the poly(methyl hydrosiloxane) oil as set forth above. The checks were then cut to standard size and presented through an amount encoder machine in order to print a series of inks on the checks showing the amount of the check. The checks were then placed in a standard golden qualifier machine in order to determine signal strength. The signal strength is a measure of the amount of ink remaining on the bank check. This test was performed primarily to determine how well the ink adhered to the bank checks which were previously subjected to a hydride fuser oil in accordance with the present invention.

As shown in Table 1 below, printing tests showed that the signal strength of the hydride oil is high and approaches that of plain paper. This is not the case for some of the comparative amino oils as shown below. The signal strength is a measure of the amount of ink remaining on the paper (bank check in this case). Therefore, the tests showed that the hydride oil of the present invention did not interfere with the adherence of ink to the bank checks, rather, the bank checks mimicked that of plain paper.

TABLE 1

Signal Strength

| Type of release agent | Average signal strength |
|---|---|
| no agent, plain paper | 109 |
| monoamino oil (Dow Corning, γ-aminopropyl substituted polydimethylsiloxane having an amine content of about 0.06 mol %) | 95 |
| mercapto oil (Wacker, γ-sulfhydrylpropyl substituted polydi- methylsiloxane having a sulfhydryl content of about 0.20 mol %) | 95 |
| Fuser Shield (Wacker, γ-aminopropyl substituted polydimethylsiloxane having an amine content of about 0.06 mol %) | 52 |
| hydride oil (Huls of America-(Huls of America PS 124.5 hydrogen substitued polydimethylsiloxane having a hydride content of about 3.5 mol %) | 99 |

The results shown in Table 1 above demonstrate that the signal strength with the hydride oil of the present invention is higher than other oils tested. In addition, the signal strength of the hydride oil mimics that of plain paper. These results show that the hydride oil with the present invention has a relatively low adherence to the paper surface, thus providing excellent qualities for post printing applications.

Example II

Experiments indicated that there was a specific interaction between the paper cellulose fibers and the amine in monoamino silicone oil but not with the hydride functional group in hydride silicone oils. One half gram of each of a monoamino oil (Dow Corning, γ-aminopropyl substituted polydimethylsiloxane having an amine content of 0.60 mole percent) and a hydride silicone oil (Huls of America PS 124.5 hydrogen substituted polydimethylsiloxane having a hydride content of 3.5 percent) was diluted with 4.5 grams of hexane and the resulting mixture was passed through 12 pipettes packed with a total of 6.7 grams of cotton cellulose. The solutions passed slowly through the columns only under the influence of gravity. The collected filtrates were dried with a stream of nitrogen. The amine functionalized fluid initially contained 0.60 mole percent amine groups, but after filtration, this amount was reduced by a third to 0.40 percent, as measured by Nuclear Magnetic Resonance Spectroscopy. On the other hand, the hydride group concentration, which was initially 3.5 percent, was nearly unchanged at 3.4 percent in the filtrate.

The results show a significant reduction in amine content filtering through the cellulose bed. This demonstrates that there was a significant adsorption of amine groups to the cellulose fibers. In contrast, when the hydride silicone oil was passed through the cellulose bed, there was a negligible reduction in hydride content measured. This data show that, unlike the monoamino fluid, the hydride silicone oil does not absorb into the paper cellulose fibers and cannot diffuse into the paper. The result is good surface adhesion of check endorser inks and attachable notes such as Post-It® Notes.

While the invention has been described in detail with reference to specific and preferred embodiments, it will be appreciated that various modifications and variations will be apparent to the artisan. All such modifications and embodiments as may readily occur to one skilled in the art are intended to be within the scope of the appended claims.

We claim:

1. A fuser member comprising:

a) a substrate;

b) an outer layer on said substrate, said outer layer comprising a fluoropolymer; and thereover c) a hydride release component comprising a silicone hydride release oil.

2. A fuser member in accordance with claim 1, wherein said fluoropolymer is selected from the group consisting of polytetrafluoroethylene, fluorinated ethylenepropylene copolymer and polyfluoroalkoxypolytetrafluoroethylene.

3. A fuser member in accordance with claim 2, wherein said fluoropolymer is polyfluoroalkoxypolytetrafluoroethylene.

4. A fuser member in accordance with claim 1, wherein said fluoropolymer is a fluoroelastomer.

5. A fuser member in accordance with claim 4, wherein said fluoroelastomer is selected from the group consisting of a) copolymers of vinylidenefluoride and hexafluoropropylene; b) terpolymers of vinylidenefluoride, hexafluoropropylene and tetrafluoroethylene; and c) tetrapolymers of vinylidenefluoride, hexafluoropropylene, tetrafluoroethylene and a cure site monomer.

6. A fuser member in accordance with claim 1, wherein said outer layer b) further comprises an inorganic particulate filler dispersed in said polymer and being present on the surface of said outer polymer layer.

7. A fuser member in accordance with claim 6, wherein said filler is selected from the group consisting of aluminum oxide and cupric oxide.

8. A fuser member in accordance with claim 7, wherein said aluminum oxide is selected from the group consisting of calcined alumina and tabular alumina.

9. A fuser member in accordance with claim 7, wherein said filler is cupric oxide.

10. A fuser member in accordance with claim 6, wherein said hydride release oil reacts with said surface filler particles thereby lowering the surface energy of said surface filler particles.

11. A fuser member in accordance with claim 6, wherein said filler is present in the fluoropolymer outer layer in an amount of about 15 to about 25 volume percent based on the volume of the fluoropolymer.

12. A fuser member in accordance with claim 6, wherein said filler is present in the fluoropolymer outer layer in an amount of about 19 to about 22 volume percent based on the volume of the fluoropolymer.

13. A fuser member in accordance with claim 1, wherein said silicone hydride release oil has a hydride content of from about 0.1 to about 5.0 weight percent.

14. A fuser member in accordance with claim 13, wherein said silicone hydride release oil has a hydride content of from about 0.5 to about 3.5 weight percent.

15. A fuser member in accordance with claim 1, wherein said silicone hydride release oil is a poly(methyl hydrosiloxane).

16. A fuser member in accordance with claim 15, wherein said silicone hydride release oil comprises pendant hydride groups.

17. A fuser member in accordance with claim 16, wherein said silicone hydride release oil contains from about 0.75 to about 3.5 weight percent pendant hydride groups.

18. A fuser member in accordance with claim 15, wherein said silicone hydride release oil comprises terminal hydride groups.

19. A fuser member in accordance with claim 18, wherein said silicone hydride release oil contains from about 0.5 to about 0.8 weight percent terminal hydride groups.

20. A fuser member in accordance with claim 17, wherein said hydride oil is a poly(methylhydrosiloxane) having 3.5 mole percent pendant hydride groups.

21. A fuser member in accordance with claim 1, wherein said silicone hydride release film further comprises a nonfunctional silicone release oil.

22. A fuser member in accordance with claim 21, wherein said nonfunctional release oil has a viscosity of from about 100 to about 20,000 cs.

23. A fuser member in accordance with claim 21, wherein said silicone hydride release oil comprises about 15 weight percent of a poly (methylhydrosiloxane) and about 85 weight percent of a nonfunctional silicone oil.

24. A fuser member in accordance with claim 1, further comprising an intermediate layer positioned between said polymer outer layer and said substrate.

25. A fuser member in accordance with claim 24, wherein said intermediate layer is an adhesive layer.

26. A fuser member in accordance with claim 1, wherein said substrate is a hollow cylindrical metal roll.

27. A fuser member in accordance with claim 1, wherein said hydride oil is provided to said polymer outer surface of the fuser roll in a thickness of from about 0.1 to about 4 micrometers.

28. A fuser member in accordance with claim 1, wherein said hydride release component is a continuous film.

29. A fuser member comprising:

a) a substrate;

b) an outer layer provided on said substrate, said outer layer comprising polyfluoroalkoxypolytetrafluoroethylene and containing an inorganic particulate filler selected from the group consisting of aluminum oxide and cupric oxide, wherein said filler is present on the surface of said outer layer; and (c) a hydride release film present on the outer layer, said hydride release film comprising a poly (methylhydrosiloxane), and wherein said hydride release film reacts with said surface filler particles so as to lower the surface energy of said filler particles.

30. A fuser member comprising:

a) a substrate;

b) an outer layer provided on said substrate, said outer layer comprising a fluoroelastomer selected from the group consisting of i) copolymers of vinylidenefluoride and hexafluoropropylene; ii) terpolymers of vinylidenefluoride, hexafluoropropylene and tetrafluoroethylene; and iii) tetrapolymers of vinylidenefluoride, hexafluoropropylene, tetrafluoroethylene and a cure site monomer, wherein said outer layer contains a calcined alumina particulate filler dispersed therein and present on the surface of the fluoroelastomer outer layer; and c) a hydride release film present on said outer fluoroelastomer layer, said hydride release film comprising a poly(methylhydrosiloxane), and wherein said hydride release film reacts with said surface filler particles so as to lower the surface energy of the filler particles.

31. An image forming apparatus for forming images on a recording medium comprising:

a) a charge-retentive surface to receive an electrostatic latent image thereon;

b) a development component to apply toner to said charge-retentive surface to develop said electrostatic latent image to form a developed image on said charge retentive surface;

c) a transfer component to transfer the developed image from said charge retentive surface to a copy substrate; and d) a fixing component for fusing toner images to a surface of said copy substrate, wherein said fixing component comprises a fuser member comprising:

i) a substrate;

ii) an outer layer provided on said substrate, said outer layer comprising a polymer; and iii) a hydride release film over said outer surface of said outer polymer layer, said hydride release film comprising a silicone hydride release oil.

32. An electrophotographic process comprising:

a) forming an electrostatic latent image on charge-retentive surface;

b) applying toner to said latent image to form a developed image on said charge retentive surface;

c) transferring the toner image from said charge-retentive surface to a copy substrate;

d) fixing said toner image to said copy substrate by passing said copy substrate containing said toner image in between a pressure member and a fixing member, wherein said pressure member and said fixing member are in pressure contact, and said fixing member comprises:

i) a substrate;

ii) an outer layer provided on said substrate, said outer layer comprising a polymer; and iii) a hydride release film over said outer surface of said outer polymer layer, said hydride release film comprising a silicone hydride release oil.

* * * * *